United States Patent [19]

Henn et al.

[11] Patent Number: 4,610,652

[45] Date of Patent: Sep. 9, 1986

[54] CONTROL FOR A FOLDING FLAP OF A FOLDING CYLINDER IN A FOLDING MACHINE OF A ROTARY PRINTING MACHINE

[75] Inventors: Manfred Henn, Heidelberg; Walter Darda, Eppelheim, both of Fed. Rep. of Germany

[73] Assignee: Heidelberger Druckmaschinen AG, Heidelberg, Fed. Rep. of Germany

[21] Appl. No.: 765,170

[22] Filed: Aug. 12, 1985

Related U.S. Application Data

[63] Continuation of Ser. No. 499,194, May 31, 1983, abandoned.

[30] Foreign Application Priority Data

May 29, 1982 [DE] Fed. Rep. of Germany ..... 3220414

[51] Int. Cl.[4] ..... B31F 1/00

[52] U.S. Cl. ..... 493/432; 493/425; 493/476

[58] Field of Search ..... 493/424, 425, 426, 428, 493/432, 434, 435, 436, 476

[56] References Cited

U.S. PATENT DOCUMENTS

| | | | |
|---|---|---|---|
| 1,413,841 | 4/1922 | Fallot | 493/426 |
| 2,950,105 | 8/1960 | Berry | 493/426 |
| 4,445,881 | 5/1984 | Bullen et al. | 493/424 |

*Primary Examiner*—Francis S. Husar
*Assistant Examiner*—Jorji M. Griffin
*Attorney, Agent, or Firm*—Herbert L. Lerner; Laurence A. Greenberg

[57] ABSTRACT

A control for a folding flap of a folding cylinder in a folding machine of a rotary printing machine wherein a counterflap is adjustable with respect to a folding blade to a thickness of paper being processed, the folding flap being controlled by a closed cam, includes a roller lever formed of a first part mounted on a journal of the folding flap, and a second part bearing a cam roller, the first and second parts being adjustable with respect to one another for changing the angular position of the folding flap so as to vary a spacing between the folding flap and the folding blade.

4 Claims, 3 Drawing Figures

CONTROL FOR A FOLDING FLAP OF A FOLDING CYLINDER IN A FOLDING MACHINE OF A ROTARY PRINTING MACHINE

This application is a continution, of application Ser. No. 499,194, filed May 31, 1983, abandoned.

The invention relates to a control for a folding flap of a folding cylinder in a folding machine of a rotary printing machine wherein a counterflap is adjustable with respect to a folding blade to a thickness of paper being processed, the folding flap being controlled by means of a closed cam.

A folding machine on a web-fed rotary printing machine is capable of producing folded products with different numbers of sides. Accordingly, the finished copies also have different thicknesses. This, in turn, must be taken into account in the individual assemblies of the folding machine, for example, in the folding-flap cylinder, the folding flaps of which must tightly hold the folded products which are of various thickness. To this end, it has been known heretofore to make the fixed counterflap adjustable so that the different copy thicknesses can be folded.

A disadvantage of the heretofore known construction is that the folding flap is more or less unilaterally displaced with respect to the folding blade. Therefore, in the case of very thick products, the fixed counterflap is set back with respect to the folding blade, whereas the controlled folding flap assumes the same closing point with respect to the folding blade. A consequence thereof is that folding differences can occur and that the unilaterally loaded folding blade may damage the copies or may even destroy itself.

Adjustable controlled folding flaps have also become known heretofore, which, however, are controlled by a simple cam plate whereon a cam roller rolls under a direct force i.e. pressure of springs. This spring pressure is constant and increases the power requirement and the rotary oscillations of the folding machine. It further requires a stronger construction of the folding flap and increases the wear on the individual moving parts.

It is accordingly an object of the invention to provide a control for a folding flap by means of a closed cam wherein the movable folding flap is also precisely adjustable with respect to the folding blade in accordance with the respective thickness of paper, without requiring a great technical expense therefor.

With the foregoing and other objects in view, there is provided, in accordance with the invention, a control for a folding flap of a folding cylinder in a folding machine of a rotary printing machine wherein a counterflap is adjustable with respect to a folding blade to a thickness of paper being processed, the folding flap being controlled by means of a closed cam, comprising a roller lever formed of a first part mounted on a journal of the folding flap, and a second part bearing a cam roller, the first and second parts being adjustable with respect to one another for changing the angular position of the folding flap so as to vary a spacing between the folding flap and the folding blade.

Due to the subdivision of the roller lever it is possible, also for a control system operating with a closed cam, to adjust the folding flap with respect to the folding blade precisely so that the latter dips or engages exactly in the middle between the folding flap and the counterflap and can produce an exact fold without damage to the folded products. This is especially important when working with very thin folded products because, in such a case, the folding flap must be virtually closed with respect to the folding blade in the engaged or dipped-in condition in order to grasp the folded product exactly.

In accordance with an additional feature of the invention, a flange is mounted on the journal of the folding flap, the second part of the roller lever being adjustably mounted on the flange by means of an eccentric pin, the second part being clampable with the eccentric pin.

In accordance with another feature of the invention, the first part of the roller lever is formed with a dovetail groove, and the second part of the roller lever is formed with a dovetail extension movably engaging in the dovetail groove, and including a threaded spindle for moving the dovetail extension in the dovetail groove so as to adjust the angular setting of the folding flap.

In accordance with a concomitant feature of the invention, the closed cam is formed with two corresponding cam paths, and the cam roller together with another cam roller being mounted via an eccentric pin in the roller lever and being rollable, respectively, on the two cam paths, one of the cam rollers having a bearing journal of eccentric construction.

The foregoing features contribute particularly to the freedom of play of the entire control system so that the folding accuracy can be increased considerably.

Other features which are considered as characteristic for the invention are set forth in the appended claims.

Although the invention is illustrated and described herein as embodied in a control for a folding flap of a folding cylinder in a folding machine of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments, when read in connection with the accompanying drawings, in which.

Figure 1:
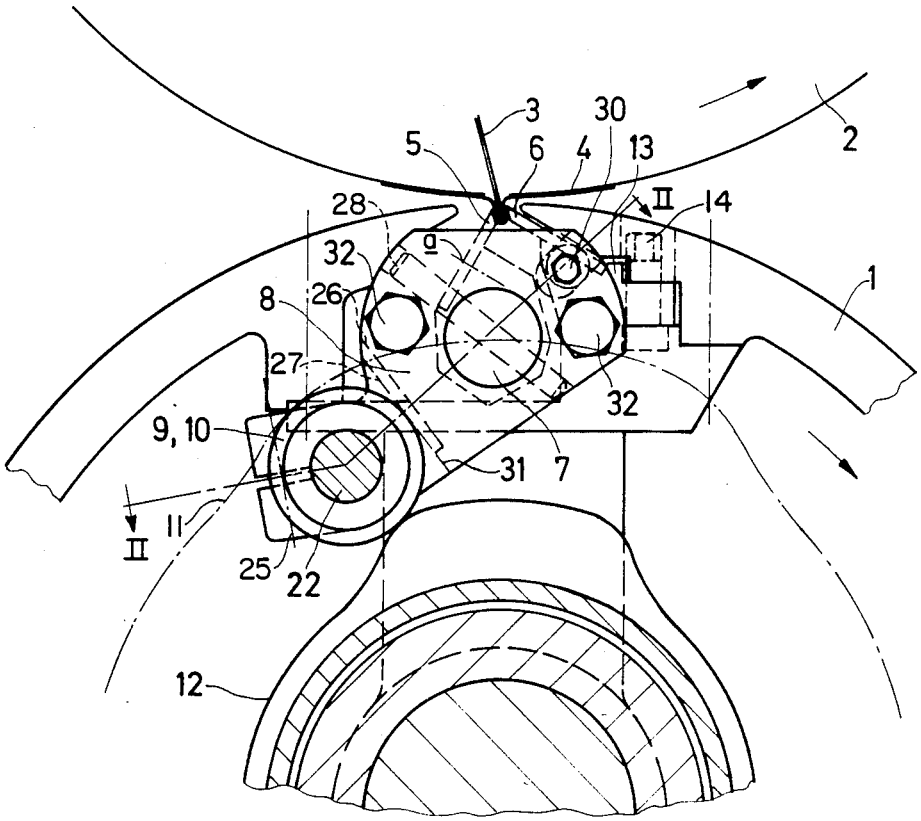
FIG. 1 is a side elevational view of a section of a folding-flap cylinder with a folding flap.

Referring now to the drawing and first, particlarly, to FIG. 1 thereof, there is shown, as provided in the folding machine of rotary printing presses in addition to other cylinders, a folding-flap cylinder 1 and a folding-blade cylinder 2 which co-operate in a manner that the folding blade 3 of the folding-blade cylinder presses the sheet 4, which is being folded, between the folding flap 5 and the counterflap 6, the sheet receiving the transverse fold thereof after the closing of the folding flap. The transverse fold, in the direction of movement of the sheet 4, can be provided in the middle of the sheet section.

According to FIG. 1, the controlled folding flap 5 is tightly secured by screws on a spindle 7 which is mounted on both sides thereof in the cylindrical body of the folding-flap cylinder 1. A roller lever 8 is provided on a journal 7' (FIG. 3) of the spindle 7 and bears cam rollers 9 and 10 at an end thereof. The cam rollers 9 and 10, in turn, roll on an inner cam 11 and an outer cam 12, respectively.

The counterflap 6 is mounted on a bracket 13 which, via two eccentric pins 14, is movable approximately in the circumferential direction of the folding flap cylinder 1 in such a manner that the counterflap 6 is adjustable with respect to the folding blade 3 to precise dimensions. After adjustment, the bracket 13 is fixed in position by means of non-illustrated screws.

How the folding flap 5 is fastened to the journal is apparent from FIG. 1 which also shows therein that the center line for the screws which fasten the folding flap 5 is disposed offset to the center of the folding-flap spindle 7. FIG. 1 is, in fact, a cross-sectional view of FIG. 2 taken along a section line extending vertically between the bearing 9 and 10 in FIG. 2, the folding flap 5 and the folding blade 3 being omitted, however, from FIG. 2.

Figure 2:
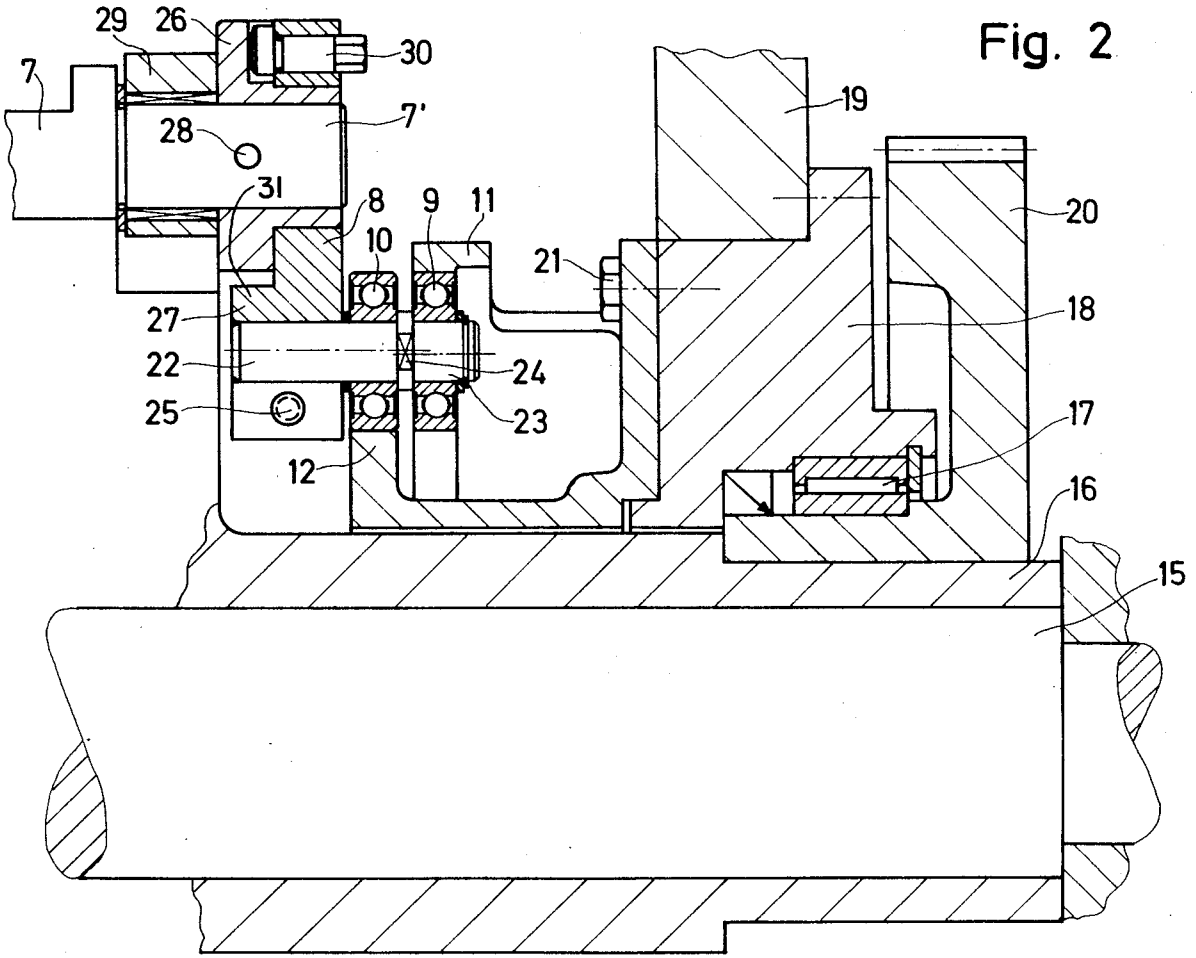
FIG. 2 is a fragmentary longitudinal sectional view of FIG. 1 taken along the line II—II in the direction of the arrows and showing the control for the folding flap.

FIG. 2 shows how the folding-flap cylinder 1 is mounted, the shaft 15 and the bearing journal 16 being supported in the side frame 19 of the press via a roller bearing 17 and a bearing holder 18. A gearwheel 20 is provided for driving the cylinder 1.

The inner cam 11 and the outer cam 12 are centrically fastened to the bearing holder 18 by means of screws 21. The two cam rollers 9 and 10 are mounted via an eccentric pin 22 in the roller lever 8, a bearing journal 23 for the cam roller 9 being eccentrically constructed. By means of a flat 24 formed on the eccentric pin 22, it is possible to turn the latter so that the cam rollers 9 and 10 are disposed free of play with respect to the inner cam 11 and the corresponding outer cam 12, respectively. After the adjustment, the eccentric pin is clamped by means of a screw 25.

The control for the folding flap is adjustable to different thicknesses of paper, the roller lever 8 being formed of a part 26 mounted on the journal 7' of the folding flap 5 and a part 27 bearing the cam rollers 9 and 10, for adjusting the folding flap 5 with respect to the folding blade 3. The part 26 is fixed on the journal 7' by means of a pin 28. The journal 7', in turn, is mounted in a bearing 29 in the cylinder body of the folding-flap cylinder 1. By means of the eccentric pin 30, the front part 27 of the roller lever 8 can be adjusted with respect to the fixed part 26 so that the distance between the folding flap 5 and the folding blade 3 is variable. The neutral or zero setting of the folding flap 5 with respect to the folding blade 3 is limited by a stop 31 (FIG. 1). After the paper thickness has been adjusted, the part 27 is clamped to the part 26 by means of clamping screws 32.

The controlled folding flap 5 is tightly secured by screws to the journal 7, those screws being represented diagrammatically by the center line thereof shown in phantom in FIG. 1. In FIG. 1 the center line of one of those screws is shown identified by the letter a. This is, of course, a conventional type of fastening for a folding flap 5.

Referring further to FIG. 2 of the drawing, it is noted that the parts 26 and 27 are centered on the journal 7' of the folding flap 5 and thus are rotatable around it. The front part 27 of the roller lever 8 is adjustable with respect to the fixed part 26 so that the distance between the folding flap 5 and the folding blade 3 is variable. The neutral or zero setting of the folding flap 5 i.e. if both halves are disposed against one another, is limited by a stop 31 (FIG. 1). If the printer wishes to process a product having a specific thickness, he or she then turns the eccentric pin 30 until the folding flap 5 shows a corresponding opening to the folding blade 3. If the printer works on thinner products, the opening must be reduced in size also by turning the eccentric pin 30. In this regard, the front part 27 is turned either away from the stop 31 or towards it, as the case may be. These adjustment operations are familiar to the printer because he or she must perform them for each change in production.

The cam rollers 9 and 10 roll on and between an inner cam 11 and an outer cam 12, respectively, as clearly shown in FIG. 2, and thereby determine the angular setting of the front part 27 of the roller lever 8. By actuating the eccentric pin 30, after the clamping screw 25 have been loosened, the bushing or fixed part 26, on which the front part 27 is mounted, is able to be turned. After the bushing 26 is connected to the journal 7' by means of the pin 28, the spindle 7 with the controlled folding flap 5 is also turned. The gap between the folding flap 5 and the folding blade 3 is thereby able to be adjusted by means of the eccentric pin 30.

During the adjustment, the bushing 26 moves centrically to the pin 7' in circumferential direction and simultaneously with respect to the part 27. This is necessary because, otherwise, an adjustment of the moving folding flap to varying product thicknesses would not be possible.

Figure 3:
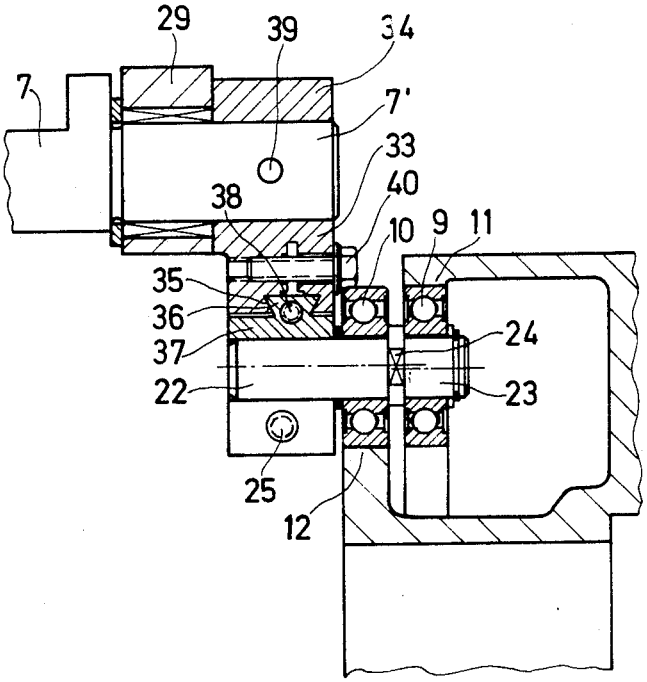
FIG. 3 is a fragmentary view of FIG. 2 showing a modified control for the folding flap.

The modified embodiment according to FIG. 3 differs from that which has been previously described herein merely by the structure of the roller lever 33. The roller lever 33 also has a part 34 mounted on the journal 7' of the folding flap 5, the part 34 being formed with a dovetail groove 35. The dovetail groove 35 is engaged by a dovetail extension 36 of a front part 37 of the roller lever 33 bearing the cam rollers 9 and 10. By means of a threaded spindle 38, the front part 37 is movable with respect to the part 34, which is fixed on the journal 7' by means of a pin 39. The angular setting of the folding flap with respect to the folding blade 3 is thereby able to be varied and thus the paper thickness to be adjusted. After the adjustment, the dovetail extension 36 is clamped in the groove 35 by means of screws 40.

In FIG. 3, instead of a pivotable manner of adjustment such as is shown in FIG. 2, a linear adjustment via the dovetail 35 is presented. As is also shown in FIG. 3 of the drawing, the dovetail guidance is in a direction perpendicular to the plane of the drawing of FIG. 3, so that the dovetail 35 extends perpendicularly to and between the jouranl 7' and the eccentric pin 22. By turning or twisting the threaded spindle 38, the printer can slide the parts 34 and 37 towards one another, which occurs somewhat along the line 31 in FIG. 1. Depending upon the direction in which the printer turns or twists the threaded spindle 38, the folding flap 5 either is displaced away from the folding plate 3 or is moved towards it. Thus, with this linear movement, an exact adjustment of the folding flap 5 can be effected in accordance with the thickness of the product. In this regard it should be taken into consideration that, in FIG. 3, the folding flap 5 is shown swung approximately 70° upwardly around the eccentric pin 22 due to draftman's requirements. The actual setting of the journal 7 and the eccentric pin 22 is clearly apparent in FIG. 1. Also, in this embodiment, the printer is solely concerned with the width of the opening of the folding flap 5 and can open or close the latter by varying the turning or rotating direction in accordance with the requirements. The stop 31 for the zero or neutral setting must be suitably adjusted in this embodiment.

With the illustrated embodiment of the invention, it is possible to adjust precisely not only the counterflap 6, but also the folding flap 5, which is controlled by means of a closed cam, with respect to the folding blade 3 in accordance with the thickness of paper being processed, so that an exact fold is attained without any occurrence of damage of whatever type.

We claim:

1. Control for a folding flap of a folding cylinder in a folding machine of a rotary printing machine wherein a counterflap is adjustable with respect to a folding blade to a thickness of paper being processed, the folding flap being controlled by means of a closed cam, comprising: a folding flap having an associated journal, a roller lever formed of a first part mounted on the journal of the folding flap, and a second part adjacent the first part, the second part bearing a cam roller, said first and second parts being adjustable with respect to one another for changing the angular position of the folding flap so as to vary a spacing between the folding flap and the folding blade.

2. Control according to claim 1, wherein a flange is mounted on said journal of the folding flap, said second part of said roller lever being adjustably mounted on said flange by means of an eccentric pin, said second part being clampable with said eccentric pin.

3. Control according to claim 1, wherein said first part of said roller lever is formed with a dovetail groove, and said second part of said roller lever is formed with a dovetail extension movably engaging in said dovetail groove, and including a threaded spindle for moving said dovetail extension in said dovetail groove so as to adjust the angular setting of the folding flap.

4. Control according to claim 1, wherein the closed cam is formed with two corresponding cam paths, and said cam roller together with a second cam roller being mounted via an eccentric pin in said roller lever and being rollable, respectively, on said two cam paths, one of said cam rollers having a bearing journal of eccentric construction.

* * * * *